US010434427B1

(12) United States Patent
Schaefer et al.

(10) Patent No.: US 10,434,427 B1
(45) Date of Patent: Oct. 8, 2019

(54) SWING SYSTEM AND METHODS OF USING SAME

(71) Applicant: MO Joy Products, LLC, St. Louis, MO (US)

(72) Inventors: Zachary A. Schaefer, Webster Groves, MO (US); David J. Ponder, Webster Groves, MO (US); Justin D. Allsup, Wildwood, MO (US); Robert W. Beckmann, St. Louis, MO (US)

(73) Assignee: MO Joy Products, LLC, St. Louis, MO (US)

( * ) Notice: Subject to any disclaimer, the term of this patent is extended or adjusted under 35 U.S.C. 154(b) by 0 days.

(21) Appl. No.: 16/043,554

(22) Filed: Jul. 24, 2018

(51) Int. Cl.

| | |
|---|---|
| ***A63G 9/16*** | (2006.01) |
| *B65H 75/40* | (2006.01) |
| *B65H 75/44* | (2006.01) |
| *A63G 9/22* | (2006.01) |

(52) U.S. Cl.
CPC ..... *A63G 9/16* (2013.01); *A63G 9/22* (2013.01); *B65H 75/4431* (2013.01); *B65H 75/4447* (2013.01)

(58) Field of Classification Search
CPC ... A63G 9/00; A63G 9/12; A63G 9/16; A63G 9/22; A01K 27/00; A01K 27/004; B65H 75/40; B65H 75/44
USPC ..... 472/118–125; 119/796
See application file for complete search history.

(56) References Cited

U.S. PATENT DOCUMENTS

| | | | | |
|---|---|---|---|---|
| 4,501,230 | A * | 2/1985 | Talo | A01K 27/004 119/796 |
| 6,095,613 | A * | 8/2000 | Ostrander | A47D 15/006 297/467 |
| 6,845,736 | B1 * | 1/2005 | Anderson | B65H 75/4431 119/796 |
| 7,837,569 | B2 | 11/2010 | Ouellet | |
| 8,251,020 | B2 | 8/2012 | Matthews | |
| 9,132,357 | B2 | 9/2015 | Aamodt et al. | |
| 9,427,673 | B2 | 8/2016 | Xu | |
| 2006/0217211 | A1 | 9/2006 | Cadotte, Jr. | |
| 2015/0128879 | A1 * | 5/2015 | Anderson | A01K 27/004 119/796 |

* cited by examiner

*Primary Examiner* — Kien T Nguyen
(74) *Attorney, Agent, or Firm* — Armstrong Teasdale LLP

(57) ABSTRACT

The present disclosure is directed to swing systems and methods of using same. In particular, the present disclosure is directed to swing propulsion systems including a belt device and a handheld swing device.

18 Claims, 6 Drawing Sheets

SWING SYSTEM AND METHODS OF USING SAME

BACKGROUND

The present disclosure is directed to swing systems, and, more specifically, to a swing propulsion system including a handheld swing device and a belt device.

In general, an adult assists a child in swinging by standing behind the child that is seated in the swing. The adult propels the child forward by exerting a pushing force against the back of the swing and/or the child. The adult continues to push the swing and/or the child until the child reaches a desired height.

However, such a method of propelling a swing has certain disadvantages. For example, the adult cannot see the child's face or expression. Being able to see the child's face serves both an emotional and functional purpose. When the child is experiencing joy or laughter, the adult cannot perceive these emotions on the child's face, as the adult is standing behind the child. Being able to see the child's gleeful nature enhances the experience of both the child and the adult. Moreover, when the child is experiencing fear or discomfort, the adult cannot perceive these emotions as the adult is behind the child. Being able to see these expressions on the child's face has a functional/safety aspect because the adult can immediately begin slowing down the swing. Conversely, when standing behind the child while pushing, it can be difficult to slow the swing. The child may reduce any swinging motions (e.g., pumping their legs) until the swing slows naturally, or the adult may grab the swing to stop the swing. However, this motion can be abrupt and may be uncomfortable for the child or risk the child falling from the swing.

Accordingly, there is a need for a system and method of swinging a child from the front, and for a system and method that enables slowing or stopping a swing more gradually.

BRIEF DESCRIPTION

In one embodiment of the present disclosure, a handheld swing device is disclosed. The swing device includes a housing, a coupling mechanism for operatively coupling the device to a swing, and a tether including a first end coupled to a spool retained in the housing and a second end coupled to the coupling mechanism. The swing device also includes a brake mechanism coupled and slideable with respect to the housing. The brake mechanism includes a first end external to the housing and an opposing second end internal to the housing and adjacent the spool, and the second end of the brake mechanism includes an arcuate edge complementary to a circumferential edge of the spool. Upon activation of the first end of the brake mechanism, the arcuate edge of the second end engages the circumferential edge of the spool to reduce rotational movement of the spool.

In another embodiment of the present disclosure, a swing system is disclosed. The swing system includes a belt device coupled to a swing and configured to retain a user in the swing, and a handheld swing device coupled to the belt device. The swing device includes a housing, a coupling mechanism for operatively coupling the device to the swing, and a tether including a first end coupled to a spool retained in the housing and a second end coupled to the coupling mechanism. The swing device also includes a brake mechanism coupled and slideable with respect to the housing. The brake mechanism includes a first end external to the housing and an opposing second end internal to the housing and adjacent the spool, and the second end of the brake mechanism includes an arcuate edge complementary to a circumferential edge of the spool. Upon activation of the first end of the brake mechanism, the arcuate edge of the second end engages the circumferential edge of the spool to reduce rotational movement of the spool.

In yet another embodiment of the present disclosure, a method for propelling a swing is disclosed. The method includes coupling a tether of a handheld device to the swing, and extending the tether from a housing of the handheld device. The extending includes at least partially unspooling the tether from a spool retained in the housing. The method also includes activating a first end of a brake mechanism coupled and slideable with respect to the housing, the first end external to the housing of the device. The brake mechanism includes an opposing second end internal to the housing and adjacent the spool, the second end of the brake mechanism including an arcuate edge complementary to a circumferential edge of the spool. The activating engages the arcuate edge of the second end with the circumferential edge of the spool to reduce rotational movement of the spool. The method further includes, upon activation of the first end of the brake mechanism, moving the device in a direction away from an initial position of the swing. The moving causes corresponding movement of the swing.

DETAILED DESCRIPTION

The present disclosure is directed to swing systems including handheld swing devices, and methods of using the same.

Specifically, FIGS. 1-6 depict an exemplary handheld swing device 100 (see FIGS. 1 and 4-6) and a belt device 102 (see FIGS. 2 and 3) that are collectively referred to as a "swing propulsion system." In some embodiments, the belt device 102 is configured to be coupled to a swing (e.g., a swing 104, shown in phantom in FIG. 2) and to retain a user (e.g., a child, not shown) in the swing 104, and the handheld swing device 100 is coupled to the belt device 102 and used to propel the swing 104 and the user therein. In some embodiments, the handheld swing device 100 is usable to propel a swing without the belt device 102, as described further herein.

Figure 1:
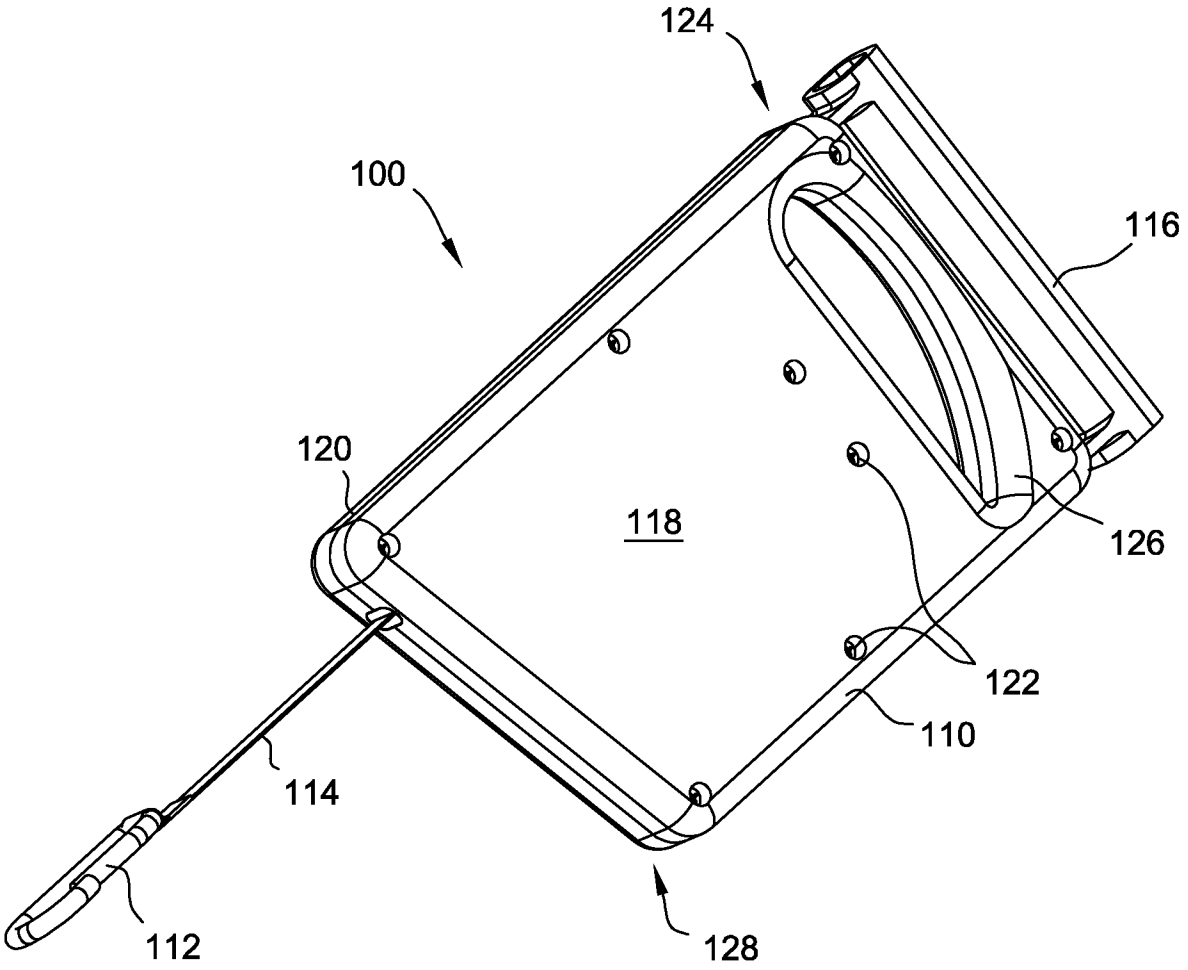
FIG. 1 is an exemplary embodiment of handheld swing device in accordance with the present disclosure.
Figure 4:
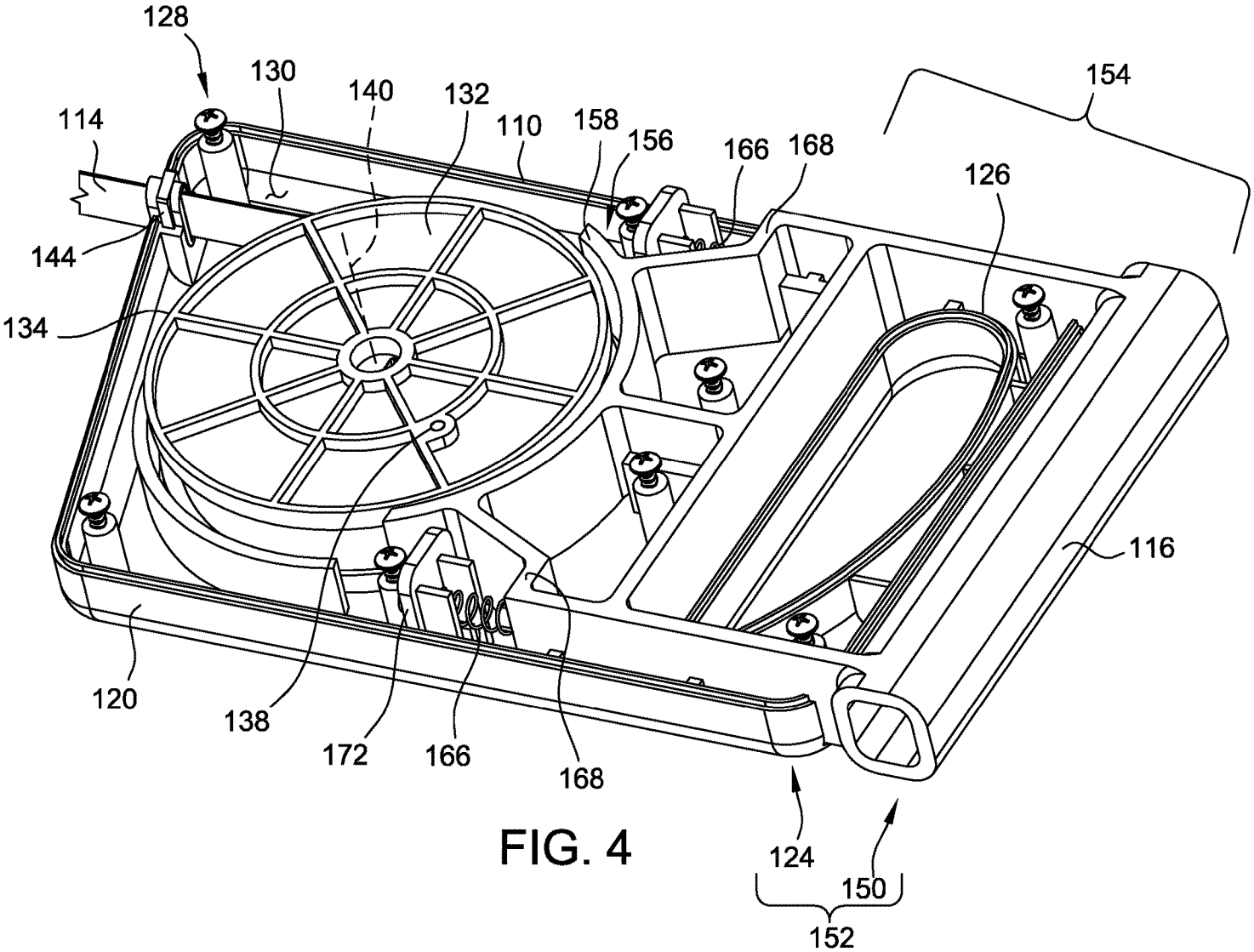
FIG. 4 is a perspective cut-away view of a handheld swing device in accordance with the present disclosure.
Figure 5:
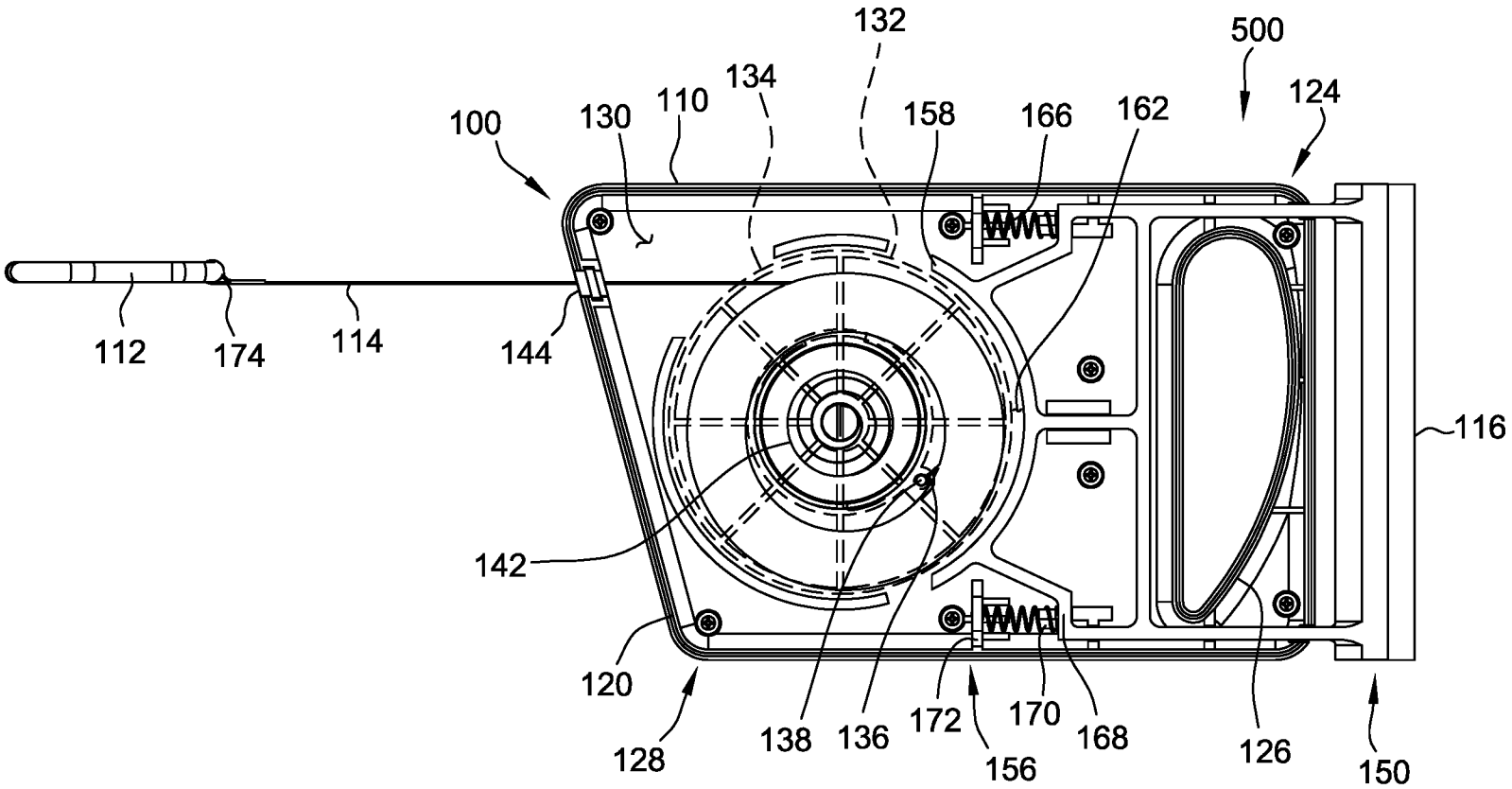
FIG. 5 is a cut-away view of a handheld swing device in accordance with the present disclosure with a brake mechanism in a first, idle configuration.
Figure 6:
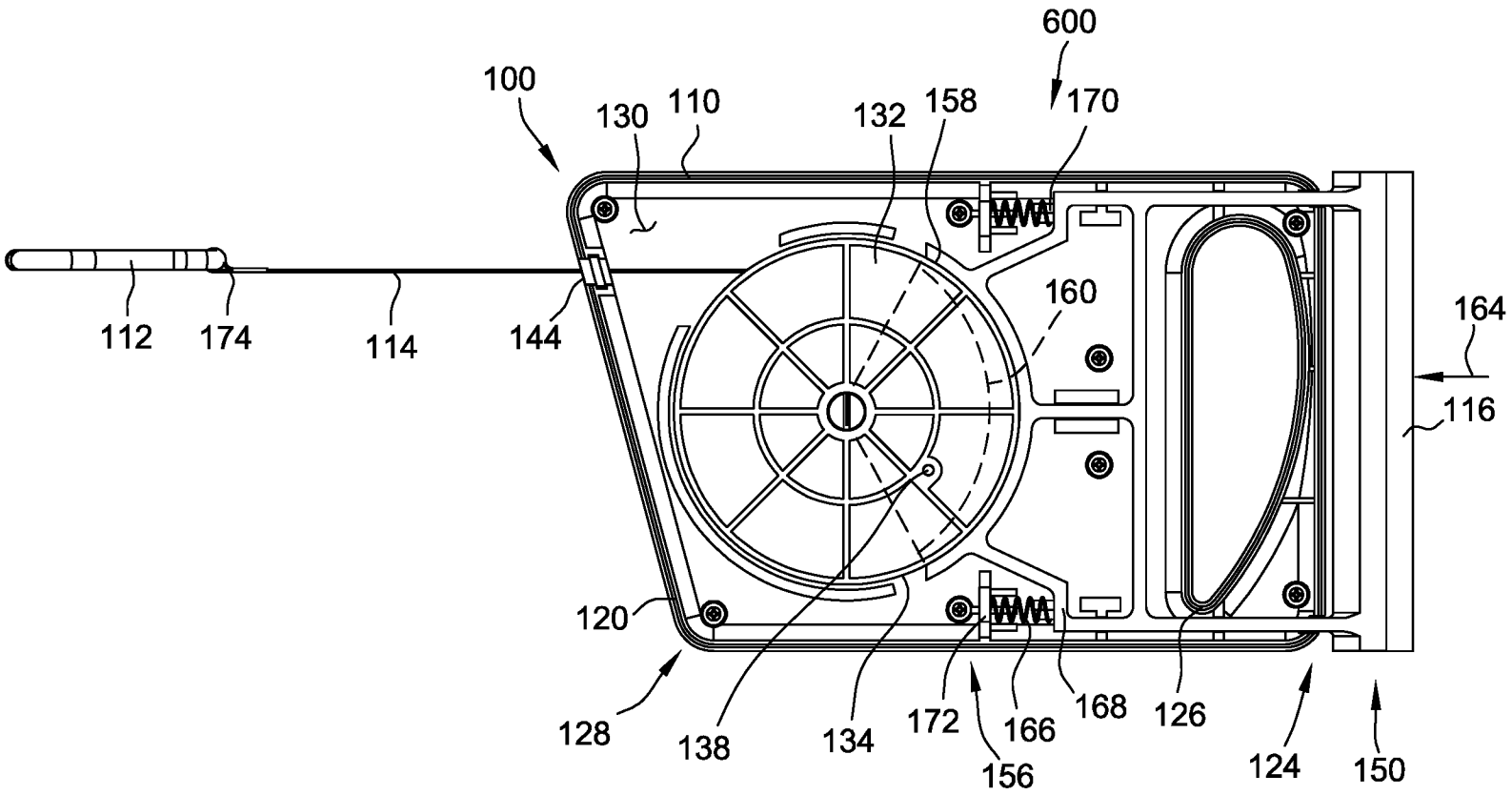
FIG. 6 is a cut-away view of a handheld swing device in accordance with the present disclosure with a brake mechanism in a second, activated configuration.

Turning to FIG. 1, the handheld swing device 100 includes, broadly, a housing 110, a coupling mechanism 112, a tether 114, and a brake mechanism 116. In some embodiments, the housing 110 includes a first portion 118 and a second portion 120 coupled to the first portion 118 using a plurality of fasteners 122 (e.g., screws). The housing 110 includes a first end 124 defining a handle portion 126 of the housing 110, and an opposing second end 128. The housing 110 retains or houses internal components of the handheld swing device 100 between the first and second portions 118, 120. FIGS. 4-6 depict the handheld swing device 100 with the first portion 118 of the housing 110 removed, such that an interior 130 of the housing 110 is visible.

In some embodiments, the housing 110 houses a spool 132 therein, the spool 132 having a circumferential edge 134. A first end 136 of the tether 114 (see FIG. 5, in which a top surface of the spool 132 is shown in phantom) is coupled to the spool 132 via a coupling pin 138, and at least a portion of the tether 114 is wound about the spool 132. The spool 132 rotates about an axis 140 to wind and unwind the tether 114 from the spool 132. In addition, a constant force spring 142 is mounted to the spool 132 to bias the spool 132 towards a wound configuration (e.g., towards clockwise rotation, with respect to the view of FIGS. 4-6), in which the tether 114 is wound about the spool 132. That is, when the tether 114 is extended from the handheld swing device 100 and unwound from the spool 132, in the absence of any other forces, the spring 142 biases the spool 132 to re-wind the tether 114 about the spool 132. An opening 144 is defined in at least one of the first and second portions 118, 120 of the housing 110 through which the tether 114 extends out of the housing 110.

The brake mechanism 116 is coupled to and slideable with respect to the housing 110. The brake mechanism 116 includes a first end 150 external to the housing 110 and adjacent to the first end 124 of the housing 110. Collectively, in some embodiments, the housing first end 124 and brake mechanism first end 150 are be referred to as a first end 152 of the handheld swing device 100, and the brake mechanism first end 150 and handle portion 126 of the housing 110 together define a handle 154 of the handheld swing device 100. The brake mechanism 116 also includes a second end 156 opposite the first end 150 and internal to the housing 110. The second end 156 of the brake mechanism 116 is positioned adjacent the spool 132. More particularly, the second end 156 of the brake mechanism 116 includes an arcuate edge 158 adjacent and complementary to the circumferential edge 134 of the spool 132. The arcuate edge 158 defines an arc 160 of at least about 90°. In some embodiments, the arcuate edge 158 defines an arc 160 (see FIG. 6) of at least about 100°, or at least about 135°, or up to about 180°.

The brake mechanism 116 is shown in a first configuration 500 in FIG. 5, in which a gap 162 is defined between the arcuate edge 158 of the brake mechanism 116 and the circumferential edge 134 of the spool 132. With the brake mechanism 116 in the first configuration 500, the spool 132 is free to rotate, in either direction, based upon the load (or lack thereof) applied to the tether 114. The first configuration 500 of the brake mechanism 116 may also be more broadly referred to as a first configuration of the handheld swing device 100. In addition, the first configuration 500 may be referred to as an idle or unactivated configuration.

The brake mechanism 116 is shown in a second configuration 600 in FIG. 6, in which the brake mechanism 116 is activated, or depressed, such that the arcuate edge 158 engages the circumferential edge 134 of the spool 132. To transition the brake mechanism 116 from the first configuration 500 to the second configuration 600, a force 164 (see FIG. 6) is applied to the first end 150 of the brake mechanism 116 towards the housing 110, referred to as an activation force 164 or depression force 164. Upon engagement of the arcuate edge 158 with the circumferential edge 134, the friction therebetween reduces rotational movement of the spool 132. Accordingly, the tether 114 is more slowly wound onto or unwound from the spool 132. As the brake mechanism 116 is further activated, or depressed, the engagement between the arcuate edge 158 and the circumferential edge 134 increases in accordance with the amount of the force 164 applied to the brake mechanism 116, thereby further reducing the rotational movement of the spool 132. When the brake mechanism 116 is "fully" activated (or cannot be further depressed), rotational movement of the spool 132 is prevented. That is, the tether 114 is prevented from being further wound or unwound. In some embodiments, the brake mechanism 116 is fully activated when the first end 150 of the brake mechanism 116 contacts the first end 124 of the housing 110. The second configuration 600 of the brake mechanism 116 may also be more broadly referred to as a second configuration of the handheld swing device 100. The second configuration 600 may be referred to as an activated or depressed configuration 600. Moreover, the second configuration 600 may include any position of the brake mechanism 116 in which the arcuate edge 158 engages the circumferential edge 134. Alternatively, "full" activation of the brake mechanism 116, such that rotational movement of the spool 132 is fully arrested, may be referred to as a third or "fully activated" configuration (not shown).

The housing 110 also includes at least one spring 166 (embodied as a pair of springs 166, in the illustrated embodiment) to bias the brake mechanism 116 in the first configuration 500. More particularly, the second end 156 of the brake mechanism 116 also includes a pair of engagement walls 168, each engagement wall 168 including a respective tab 170 extending therefrom. A pair of engagement projections 172 extend from the second portion 120 of the housing 110. Each spring 166 is mounted on a respective tab 170, and extends between one engagement wall 168 and the corresponding engagement projection 172. When the brake mechanism 116 is activated or depressed (i.e., transitioned to the second configuration 600), the springs 166 are compressed. Accordingly, when the activation or depression force 164 is removed, the springs 166 release and return the brake mechanism 116 to the first configuration 500.

Figure 2:
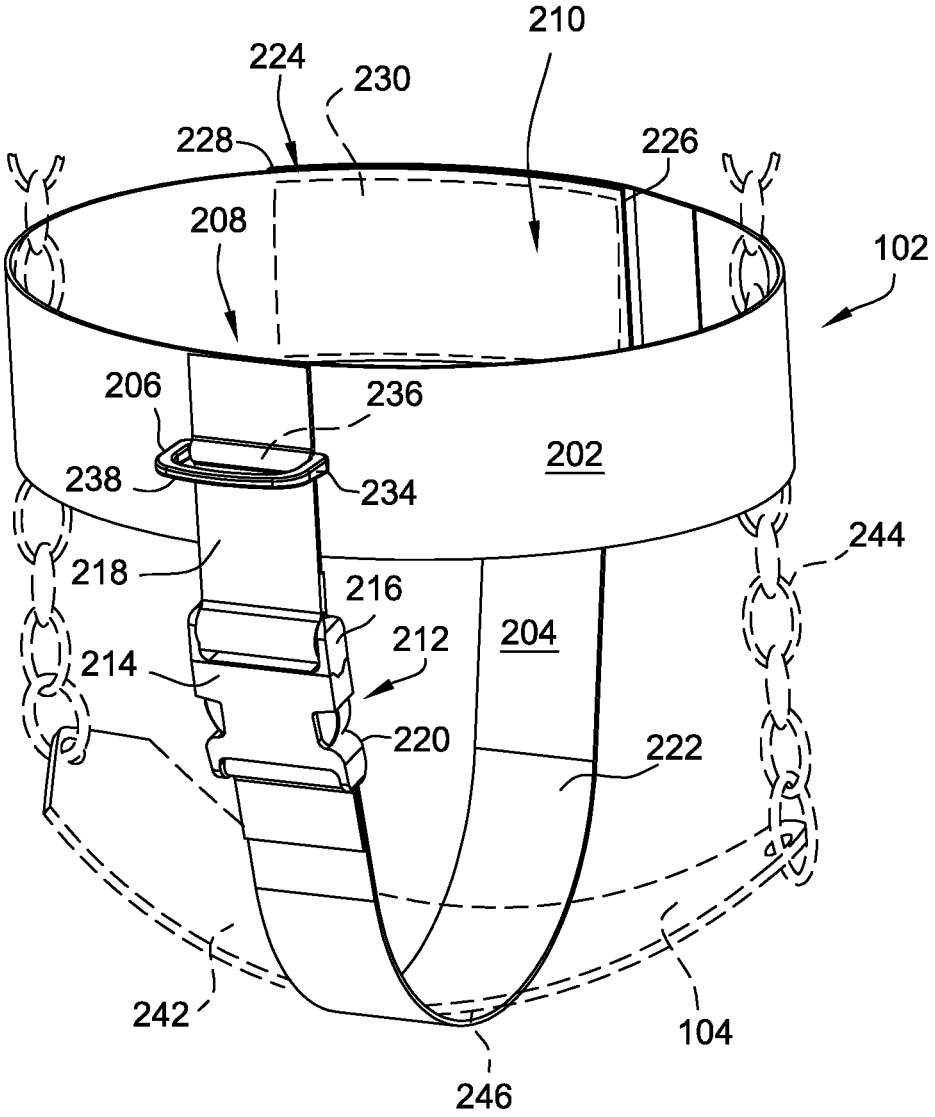
FIGS. 2 and 3 depict an exemplary embodiment of a belt device in accordance with the present disclosure.

The coupling mechanism 112 is configured to operatively couple the handheld swing device 100 to a swing (e.g., swing 104, shown in FIG. 2). As used herein, "operatively coupling" the handheld swing device 100 to the swing 104 is intended to refer broadly both to direct coupling of the handheld swing device 100 to the swing 104 and to indirect coupling of the handheld swing device 100 to the swing 104 via the belt device 102 (which is, in turn, directly coupled to the swing 104). In some embodiments, the coupling mechanism 112 is coupled to a second end 174 of the tether 114, also referred to as a "free end" 174 of the tether 114. The coupling mechanism 112 is embodied as a hook, latch, or carabiner. In some embodiments, the coupling mechanism 112 alternatively includes any suitable coupling mechanism, such as an alternative fastener. Moreover, in some embodiments the coupling mechanism 112 is formed with the tether 114. In some embodiments, the coupling mechanism 112 includes a snap or hook-and-loop type fastener configured to engage with a complementary fastener at a location proximal of the second end 174 of the tether 114, such that the second end 174 of the tether 114 is looped around the swing 104 (or belt device 102) and re-attach to itself to form the coupling mechanism 112.

In operation of the handheld swing device 100, the second end 174 of the tether 114 is extended away from the housing 110, such that the tether 114 is at least partially unspooled from the spool 132. In some embodiments, the tether 114 is used to directly couple the handheld swing device 100 to the swing 104. In some embodiments, the tether 114 is looped around a portion of the swing 104 and the coupling mechanism 112 is coupled to the tether 114 (e.g., the carabiner is latched about the tether 114). In some embodiments, the coupling mechanism 112 is coupled directly to the swing (e.g., the carabiner is latched to a chain of the swing 104). In other embodiments, the coupling mechanism 112 is used to couple the handheld swing device 100 to the belt device 102, as described further herein.

To propel the swing 104, the brake mechanism 116 is activated or transitioned from the first configuration 500 to the second configuration 600. That is, a user exerts an activation force 164 on the first end 150 of the brake mechanism 116. In some embodiments, the user fully activates the brake mechanism 116 such that rotational movement of the spool 132 is fully prevented. In such an embodiment, upon activation of the brake mechanism 116, a distance defined between the second end 174 of the tether 114 and the housing 110 is fixed, as the tether 114 is not permitted to unwind from the spool 132. In some embodiments, the user then draws the handheld swing device 100 in a direction away from an initial position of the swing 104 (e.g., backwards and/or upwards). As the tether 114 is not permitted to unwind, such a motion causes corresponding movement of the swing 104, drawing the swing 104 upwards and towards the user.

The user then releases the brake mechanism 116. The springs 166 force the brake mechanism 116 back to the first configuration 500, which also frees the spool 132. The spool 132, free to rotate, permits the tether 114 to unwind therefrom and the swing 104 to swing away from the user. That is, upon release of the first end 150 of the brake mechanism 116, the distance defined between the second end 174 of the tether 114 and the housing 110 is increased to permit propulsion of the swing 104. This process is able to be repeated one or more times to continue to propel the swing 104.

The handheld swing device 100 is also usable to gradually and safely slow and/or stop the swing 104 after a swinging motion is achieved. The user gradually activates the brake mechanism 116 to transition the brake mechanism 116 from the first configuration 500 to the second configuration 600. The brake mechanism 116 engages the spool 132 to reduce rotational movement of the spool 132. The tether 114 is permitted to unwind more slowly from the spool 132, reducing acceleration of the second end 174 of the tether 114 away from the housing 110 and, thereby, reducing acceleration of the swing 104 away from the user. The user is able to fully activate the brake mechanism 116 to fully arrest rotational movement of the spool 132 at any time, to fully arrest movement of the swing 104. In some embodiments, as the user is slowing and/or stopping the swing 104, upon releasing the brake mechanism 116, the distance defined between the second end 174 of the tether 114 and the housing 110 is decreased.

Figure 3:
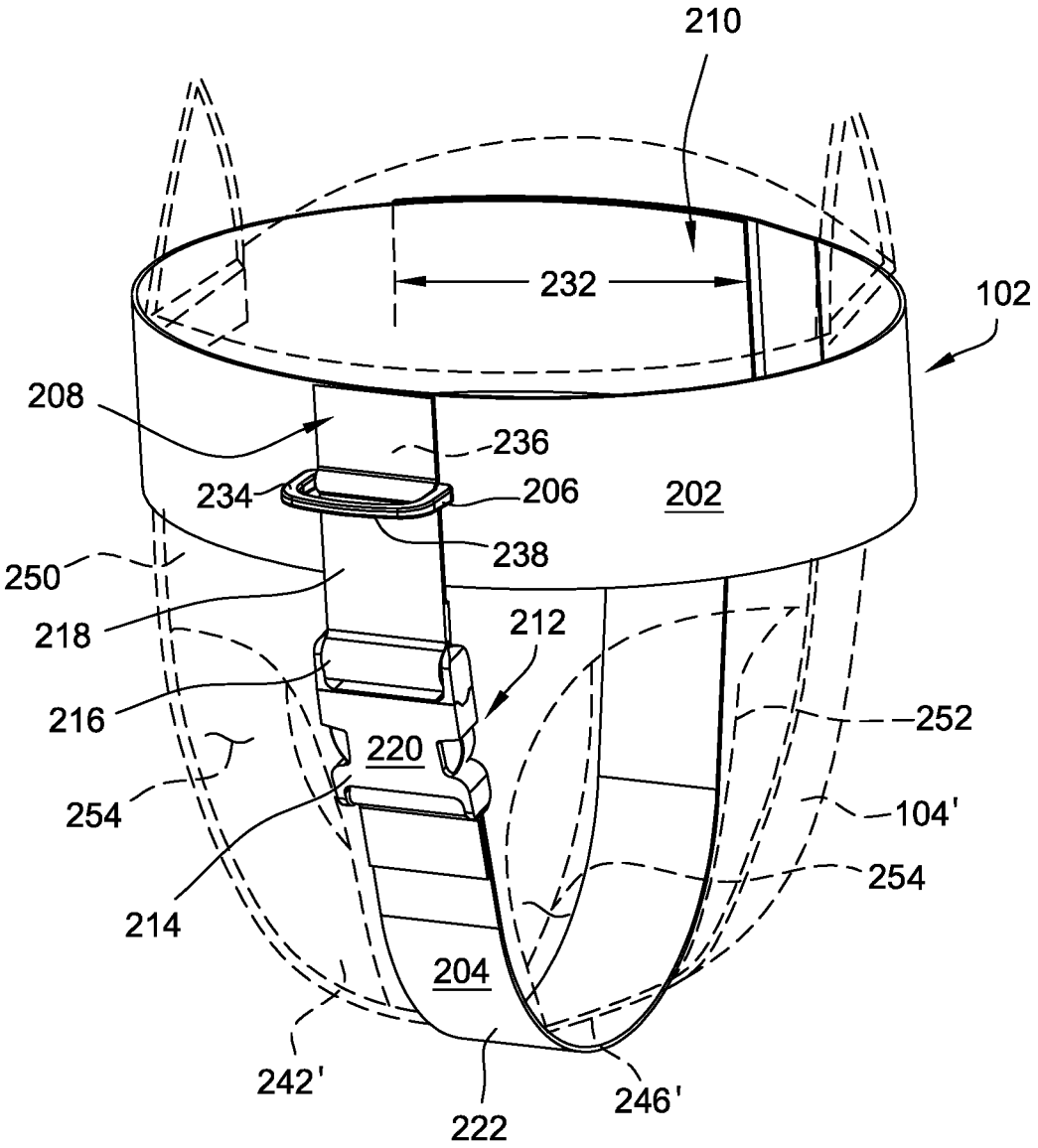

Turning now to FIGS. 2 and 3, an exemplary embodiment of the belt device 102 is depicted as coupled to a swing 104. The belt device 102 broadly includes a waist band 202, a transverse band 204 coupled to the waist band 202, and an engagement component 206 configured to enable coupling of the handheld swing device 100 (e.g., the coupling mechanism 112) to the belt device 102. In some embodiments, the waist band 202 and the transverse band 204 are formed as a single, unitary component. In other embodiments, the waist band 202 and the transverse band 204 are separately formed and coupled together. The waist band 202 and the transverse band 204 are coupled together using any suitable method, such as using one or more fasteners (e.g., threads, snaps, hook-and-loop fasteners, etc.), using adhesive(s), using heat to join the bands, any combination thereof, and/or using any other suitable coupling method. In some embodiments, the waist band 202 and the transverse band 204 comprise the same material or comprise different materials, the material(s) including, but not limited to, natural fabric, synthetic fabric, polymeric materials, elastic materials, and/or any other suitable material. In at least some embodiments, it is preferable to have a material that is at least partially elastic, such that the belt device 102 is usable with swings of varying sizes, shapes, and dimensions.

In some embodiments, the transverse band 204 is coupled to the waist band 202 at two opposing locations, corresponding to a front 208 and a rear 210 of the waist band 202 (also referred to as a front 208 and rear 210 of the belt device 102). The transverse band 204 includes a closure 212 to open and close the transverse band 204 and facilitate putting the belt device 102 onto the swing 104, maintaining coupling of the belt device 102 to the swing 104, and subsequently removing the belt device 102 from the swing 104. In the illustrated embodiment, the closure 212 is embodied as a buckle 214. A first portion 216 of the buckle 214 is coupled to a first portion 218 of the transverse band 204, which is coupled to and extends from to the front 208 of the waist band 202. A second portion 220 of the buckle 214 is coupled to a second portion 222 of the transverse band 204, which is coupled to and extends from the rear 210 of the waist band 202. The first and second portions 216, 220 of the buckle 214 engage to close the buckle 214, and disengage to open the buckle 214. In some embodiments, the closure 212 is embodied as any alternative closure without departing from the scope of the present disclosure, such as snaps, hook-and-loop fasteners, latches, buttons, knots, and/or any suitable closure.

In some embodiments, the waist band 202 includes a releasable bond portion 224 defined by a first end 226 of the waist band 202 and a second end 228 of the waist band 202. Specifically, the second end 228 overlaps and couples to the first end 226 to form the releasable bond portion 224. The releasable bond portion 224 facilitates opening and closing the waist band 202, and further facilitates putting the belt device 102 onto the swing 104, maintaining coupling of the belt device 102 to the swing 104, and subsequently removing the belt device 102 from the swing 104. In some embodiments, each of the first end 226 and the second end 228 of the waist band 202 includes a respective hook-and-loop fastener 230, such that when the second end 228 is positioned in an overlapping relationship with the first end 226 the second end 228 is releasably coupled to the first end 226. Moreover, in some embodiments the first and second ends 226, 228 are coupled to one another with varying overlap lengths 232 (see FIG. 3), to accommodate coupling the belt device 102 to varying sizes of swings 104.

The engagement component 206 is coupled to the waist band 202 and/or to the transverse band 204 and facilitates coupling of the handheld swing device 100 (specifically, the coupling mechanism 112 thereof) to the belt device 102. In the illustrated embodiment, the engagement component 206 is embodied as a rigid ring 234. The ring 234 includes a first side 236 embedded in the material of the waist band 202 and/or the transverse band 204, and a second side 238 opposing the first side 236 and exposed, to facilitate coupling of the coupling mechanism 112 thereto. In some embodiments, the engagement component 206 includes additional and/or alternative components, such as non-rigid (e.g., elastic, flexible, and/or semi-flexible) ring or loop, a hook, a latch, and/or any other suitable component.

In operation, in some embodiments, a user opens the waist band 202 by de-coupling the second end 228 thereof from the first end 226, opens the closure 212 of the belt device 102 to decouple the first portion 218 of the transverse band 204 from the second portion 222 of the transverse band 204. The user draws the waist band 202 around the swing 104 and couples the second end 228 of the waist band 202 is coupled to the first end 226 thereof to couple the waist band 202 around the swing 104. The user then closes the closure 212 to couple the first and second portions 218, 222 of the transverse band 204. In some embodiments, a child (or other swinging user) is already seated in the swing 104 when the belt device 102 is coupled to the swing 104. In other embodiments, the child is seated in the swing 104 after the belt device 102 is coupled to the swing 104. When the belt device 102 is coupled to the swing 104 and the child is seated in the swing 104, the belt device 102 is considered to be coupled to both the child in the swing 104 and to the swing 104.

In FIG. 2, the belt device 102 is depicted as coupled to a single-panel type swing 104, in which a single-panel swing seat 242 is coupled to a pair of chains 244. In such an embodiment, the waist band 202 is positioned about the chains 244, and the transverse band 204 extends from the front 208 to the rear 210 of the belt device 102 across a bottom 246 of the swing seat 242. In FIG. 3, the belt device 102 is depicted as coupled to a bucket type swing 104' intended for smaller children, such as infants or toddlers. The swing seat 242' includes additional panels to secure a child therein, including a horizontal or lateral panel 250 and a transverse panel 252, defining openings 254 for a child's legs. In such an embodiment, the waist band 202 is positioned about the lateral panel 250 of the swing seat 252' (or above or below the lateral panel 250, depending on the particular dimensions of the swing 104'), and the transverse band 204 extends from the front 208 to the rear 210 of the belt device 102 across a bottom 246' of the swing seat 242'.

The user is able to couple the coupling mechanism 112 of the handheld swing device 100 to the engagement component 206 of the belt device 102. Operation of the handheld swing device 100 then proceeds as described above herein.

It is understood that though various embodiments of the present disclosure refer to an adult and child using the device and system, the present disclosure is not limited to this particular combination. That is, in some embodiments, the operator/user of the handheld device is an adult, an adolescent or an older child. In some embodiments, the person sitting in the swing and/or swing seat device is a child, an adult, or an adolescent. There are no age limits that are associated with either of the two positions.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A handheld swing device comprising:

a housing comprising a handle portion;

a coupling mechanism for operatively coupling the device to a swing;

a tether including a first end coupled to a spool retained in the housing and a second end coupled to the coupling mechanism; and a brake mechanism coupled and slideable with respect to the housing, the brake mechanism comprising a first end external to the housing, wherein the handle portion of the housing is adjacent the first end of the brake mechanism, and an opposing second end internal to the housing and adjacent the spool, the second end of the brake mechanism comprising an arcuate edge complementary to a circumferential edge of the spool, wherein, upon activation of the first end of the brake mechanism, the arcuate edge of the second end engages the circumferential edge of the spool to reduce rotational movement of the spool, and wherein activation of the first end of the brake mechanism engages the first end of the brake mechanism with the handle portion of the housing.

2. The device of claim 1, wherein the brake mechanism is biased in a first, unactivated position.

3. The device of claim 2, wherein at least one spring is positioned adjacent the second end of the brake mechanism to bias the brake mechanism in the first position.

4. The device of claim 1, wherein the spool comprises a spring to bias the spool towards a first, wound configuration in which the tether is wound about the spool.

5. The device of claim 1, wherein, upon activation of the first end of the brake mechanism, the arcuate edge of the second end engages the circumferential edge of the spool to arrest rotational movement of the spool.

6. The device of claim 5, wherein, upon activation of the first end of the brake mechanism, a distance defined between the second end of the tether and the housing is fixed.

7. The device of claim 6, wherein, upon release of the first end of the brake mechanism, the distance defined between the second end of the tether and the housing is increased to permit propulsion of the swing.

8. The device of claim 6, wherein, upon release of the first end of the brake mechanism, the distance defined between the second end of the tether and the housing is decreased.

9. A swing system comprising:

a belt device coupled to a swing and configured to retain a user in the swing; and a handheld swing device coupled to the belt device, the swing device comprising:

a housing comprising a handle portion;

a coupling mechanism for operatively coupling the device to the swing;

a tether including a first end coupled to a spool retained in the housing and a second end coupled to the coupling mechanism; and a brake mechanism coupled and slideable with respect to the housing, the brake mechanism comprising a first end external to the housing, wherein the handle portion of the housing is adjacent the first end of the brake mechanism, and an opposing second end internal to the housing and adjacent the spool, the second end of the brake mechanism comprising an arcuate edge complementary to a circumferential edge of the spool, wherein, upon activation of the first end of the brake mechanism, the arcuate edge of the second end engages the circumferential edge of the spool to reduce rotational movement of the spool, and wherein activation of the first end of the brake mechanism engages the first end of the brake mechanism with the handle portion of the housing.

10. The swing system of claim 9, wherein the belt device comprises a waist band configured to couple the belt device to at least one of the swing and a wearer.

11. The swing system of claim 10, wherein the belt device further comprises a transverse band coupled to the waist band, the transverse band configured to couple the belt device to at least one of the swing and the wearer.

12. The swing system of claim 11, wherein the belt device further comprises an engagement component coupled to at least one of the waist band and the transverse band, and wherein the coupling mechanism of the device is configured to couple to the engagement component.

13. The swing system of claim 12, wherein the engagement component comprises a ring component and the coupling mechanism comprises a hook component.

14. The swing system of claim 9, wherein the belt device further comprises an engagement component, and wherein the coupling mechanism of the device is configured to couple to the engagement component.

15. A method for propelling a swing, the method comprising:

coupling a tether of a handheld device to the swing;

extending the tether from a housing of the handheld device, said extending comprising at least partially unspooling the tether from a spool retained in the housing, the housing including a handle portion;

activating a first end of a brake mechanism coupled and slideable with respect to the housing, the first end external to the housing of the device, wherein the handle portion of the housing is adjacent the first end of the brake mechanism, wherein the brake mechanism includes an opposing second end internal to the housing and adjacent the spool, the second end of the brake mechanism including an arcuate edge complementary to a circumferential edge of the spool, said activating engaging the arcuate edge of the second end with the circumferential edge of the spool to reduce rotational movement of the spool and engaging the first end of the brake mechanism with the handle portion of the housing; and upon activation of the first end of the brake mechanism, moving the device in a direction away from an initial position of the swing, said moving causing corresponding movement of the swing.

16. The method of claim 15, further comprising releasing the first end of the brake mechanism, said releasing permitting the tether to further unspool from the spool and the swing to swing away from the device.

17. The method of claim 15, wherein coupling the tether to the swing includes coupling the tether to a belt device configured to retain a user in the swing.

18. The method of claim 17, wherein coupling the tether to the belt device includes coupling a waist band of the belt device to at least one of the swing and the user; and coupling a transverse band of the belt device to the swing, the transverse band coupled to the waist band.

* * * * *